US008388116B2

(12) United States Patent
Mardilovich et al.

(10) Patent No.: US 8,388,116 B2
(45) Date of Patent: Mar. 5, 2013

(54) PRINTHEAD UNIT

(75) Inventors: Peter Mardilovich, Corvallis, OR (US); Tony S Cruz-Uribe, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 297 days.

(21) Appl. No.: 12/610,196

(22) Filed: Oct. 30, 2009

(65) Prior Publication Data

US 2011/0102516 A1 May 5, 2011

(51) Int. Cl.
*B41J 2/045* (2006.01)

(52) U.S. Cl. ..... 347/70

(58) Field of Classification Search ..... 347/70, 347/69

See application file for complete search history.

(56) References Cited

U.S. PATENT DOCUMENTS 7,159,966 B2 1/2007 Taira
7,240,996 B2 * 7/2007 Kobayashi et al. ..... 347/68
2006/0077237 A1 * 4/2006 Shin et al. ..... 347/71
2007/0236541 A1 * 10/2007 Wijshoff ..... 347/69
2009/0073242 A1 3/2009 Xu et al.

FOREIGN PATENT DOCUMENTS

JP 2007268962 10/2007
KR 20030050477 6/2003

OTHER PUBLICATIONS

International Search Report for Application No. PCT/US2010/054700. Report issued Jul. 28, 2011.

* cited by examiner

*Primary Examiner* — Matthew Luu
*Assistant Examiner* — Lisa M Solomon

(57) ABSTRACT

Piezoelectric unit, comprising a fluid chamber, a fluid outlet, an actuator, comprising a thin film piezoceramic element and a membrane, acting as a wall of the fluid chamber, and a support element arranged for preventing a supported portion of the actuator from movement in a main direction of actuation movement of the actuator, while allowing such actuation movement on at least two sides of the supported portion, wherein the support element is connected to a unit portion that extends approximately opposite to the actuator.

15 Claims, 12 Drawing Sheets

PRINTHEAD UNIT

BACKGROUND OF THE INVENTION

In piezoelectric inkjet printheads, ink or other fluid is typically ejected in the form of drops. The fluid travels from various fluid chambers, through various nozzles, onto a substrate. The fluid is ejected by movement of a piezoelectric element. The fluid chamber has a wall that consists of a piezoelectric actuator, typically a membrane that is connected to the piezoelectric element. The fluid is moved towards the nozzle by vibration movement of the membrane actuated by the piezoelectric element.

At present, piezoelectric actuators of the unimorph type comprise a flexible membrane that is integrated with or attached to a piezoelectric layer. When the actuator has a relatively small thickness, e.g. between 1 and 10 micron, such as with thin film piezoceramic and thin membrane layers, the maximum width it may span over the fluid chamber is usually at most between 50-100 micron or less. At larger spans, the actuator is unsuitable to achieve a desired frequency and/or pressure. Therefore, the fluid chamber usually has an elongate shape, so that the maximum width is between about 50-100 micron or less, while its length is significantly larger, e.g. between 0.5 mm-2 mm.

It is an object of the invention to provide for an alternative piezoelectric method and device.

BRIEF DESCRIPTION OF THE DRAWINGS

For the purpose of illustration, certain embodiments of the present invention will now be described with reference to the accompanying diagrammatic drawings, in which.

DETAILED DESCRIPTION

Figure 1B:
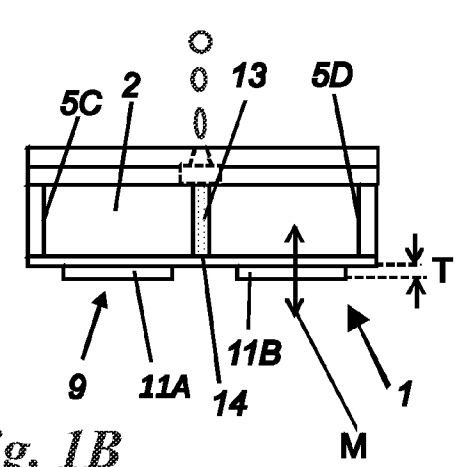
FIG. 1B is a schematic cross sectional front view of the piezoelectric inkjet printhead unit of FIG. 1A.
Figure 1A:
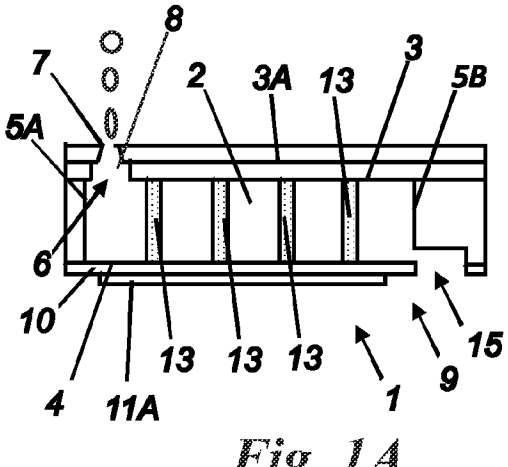
FIG. 1A is a schematic cross sectional side view of a piezoelectric inkjet printhead unit.

In the following detailed description, reference is made to the accompanying drawings. The embodiments in the description and drawings should be considered illustrative and are not to be considered as limited to the specific embodiment of element described. For illustrative purposes, the scale and relative dimensions are not as they would be in practice.

The indicated views in the drawings should not be considered as limiting for the orientation of the element or device. For example, a top view could also represent a bottom view, or a side view, etc., depending on the orientation of the respective element(s). However, multiple views of a single embodiment may indicate the relative relationships and relative orientation of the shown features. Accordingly, a top wall may be regarded as a bottom wall, and vice versa, depending on the orientation and use of the device, while the relationships between the bottom and top wall with respect to each other and with respect to the device may be preserved. The same principle may account for other features, e.g. a length or width of a feature may be chosen in any consistent manner.

Multiple embodiments may be derived from the following description through modification, combination or variation of certain elements. Furthermore, embodiments or elements that may not be specifically disclosed in this disclosure may be derived from the description and drawings.

FIG. 1 shows a piezoelectric unit 1. The unit 1 may comprise a piezoelectric inkjet printhead unit 1, which may form a part of a piezoelectric inkjet printhead. In the art, a piezoelectric inkjet printhead unit 1 may also be referred to as a "jet". The unit 1 may comprise a fluid chamber 2. The volume of the fluid chamber 2 may be determined by at least one wall 3, 4, 5A-D. The at least one wall may comprise a top wall 3, a bottom 4 and a number of side walls 5A, 5B, 5C, 5D. The unit 1 may comprise a fluid outlet 6 that opens into the fluid chamber 2. The outlet 6 may comprise a nozzle 7. Optionally, the outlet 6 may comprise a descender 8 for guiding the fluid from the fluid chamber 2 to the nozzle 7. In FIGS. 1A and 1B, fluid drops are shown to shoot out of the nozzle 7 in an advance direction.

The unit 1 may comprise an actuator 9. The actuator 9 may comprise a thin film actuator 9. The actuator 9 may function as a wall of the fluid chamber 2, for example as a bottom or a top wall of the fluid chamber 2, hereafter referred to as the actuator wall. The actuator 9 may comprise a membrane 10 and at least one piezoceramic element 11. The piezoceramic element 11 may comprise a thin film piezoceramic element 11. Both the membrane 10 and the piezoceramic element 11 may comprise thin film material. The thin film piezoceramic element 11 may comprise deposited or deposited and sintered piezoceramic material. The membrane 10 may form the wall of the fluid chamber 2. In an embodiment, one actuator 9 may comprise one membrane 10 extending along one fluid chamber 2, the actuator 9 comprising multiple piezoceramic elements 11A, 11B extending along the same fluid chamber 2.

Figure 1D:
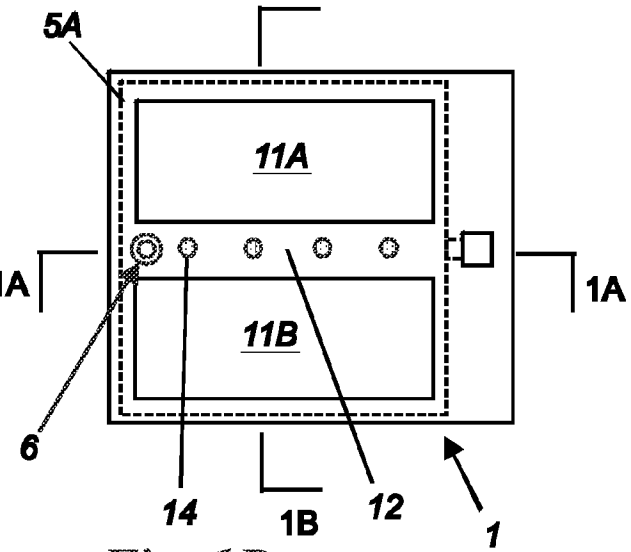
FIG. 1D is a schematic bottom view of the piezoelectric inkjet printhead unit of FIGS. 1A, 1B and 1C, wherein several parts are shown by dashed lines for illustrative purposes.
Figure 1C:
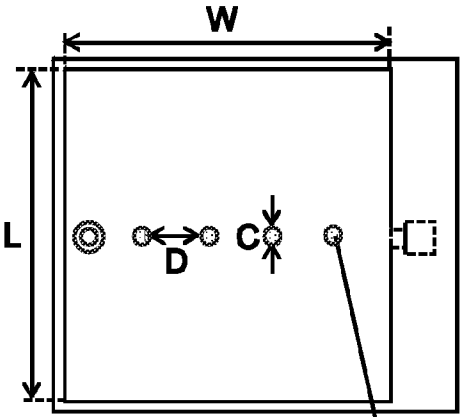
FIG. 1C is a schematic top view of the piezoelectric inkjet printhead unit of FIGS. 1A and 1B, wherein the nozzle plate is made transparent for illustrative purposes.
Figure 2A:
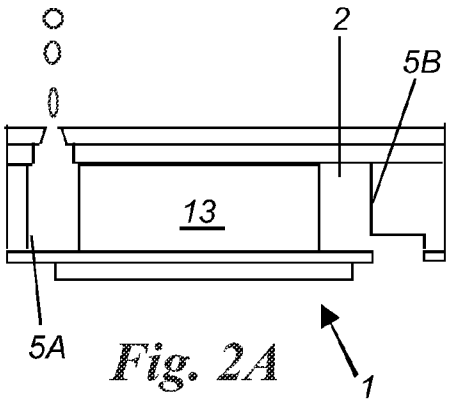
FIG. 2A is a schematic cross sectional side view of a piezoelectric inkjet printhead unit.
Figure 2B:
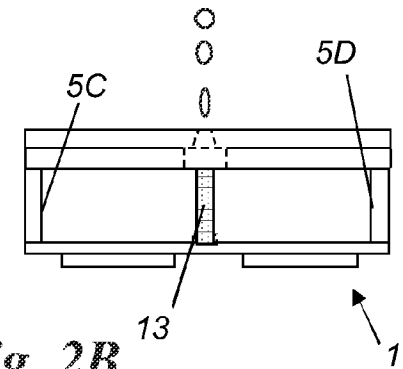
FIG. 2B is a schematic cross sectional front view of the piezoelectric inkjet printhead unit of FIG. 5A.
Figure 2C:
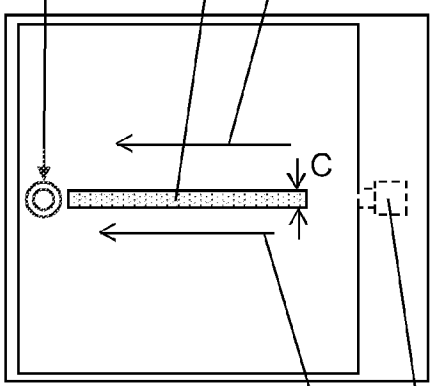
FIG. 2C is a schematic top view of the piezoelectric inkjet printhead unit of FIGS. 2A and 2B, wherein the nozzle plate is made transparent for illustrative purposes.
Figure 2D:
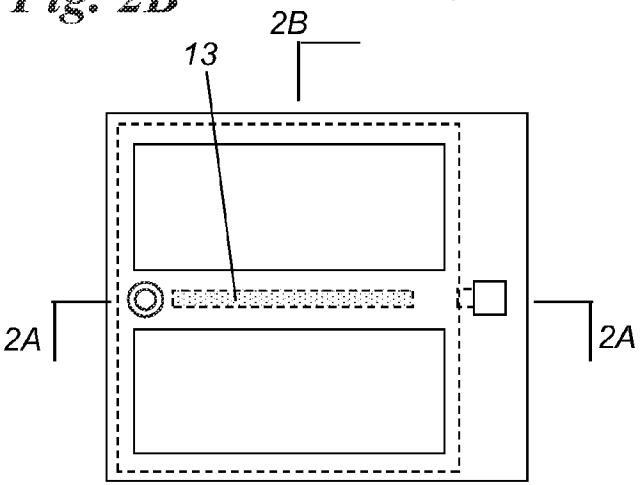
FIG. 2D is a schematic bottom view of the piezoelectric inkjet printhead unit of FIGS. 2A, 2B and 2C, wherein the chamber bottom, the inlet, and the outlet are shown by dashed lines for illustrative purposes.

The piezoceramic material may be patterned onto the membrane 10. A "patterned" piezoceramic element 11 may be understood as the piezoceramic element 11 comprising at least one interruption 12 above the fluid chamber 2. For example, the actuator 9 may comprise parts of a membrane 10 that are not covered by piezoceramic material between other parts of the same membrane 10 that are covered by piezoceramic material. Another patterned piezoceramic element 11 may comprise multiple piezoceramic elements 11A, 11B that are provided on one actuator 9. The exemplary piezoceramic element 11 of FIG. 1A-D is patterned as is shown by the fact that it comprises two piezoceramic elements 11A, 11B in between which an interruption 12 is provided, as can be seen in FIGS. 1B and 1D.

The unit 1 may comprise a support element 13. As shown, the unit 1 may comprise multiple support elements 13. The support elements 13 may be arranged for preventing a supported portion 14 of the actuator 9 from movement in a main direction of actuation movement M of the actuator 9. The support element 13 may be connected to a printhead unit portion that extends approximately opposite to the actuator 9. The support element 13 may be connected to a rigid portion of the printhead. The printhead portion to which the support element 13 is connected may for example comprise part of a chamber wall 3 that is opposite to the actuator wall 4, for example a bottom or top wall 3 or 4 of the fluid chamber 2, depending on which one comprises the actuator wall. The support element 13 may allow for a thin film actuator 9 to extend over the entire fluid chamber 2; whereas, without the support element 13 the actuator 9 would be two or more times thicker.

The supported portion 14 may comprise a portion of the membrane 10 that is connected to the support element 13. The support element 13 may support the actuator 9 in the direction of actuation movement M, so that the supported portion 14 and the support element 13 may remain relatively static while surrounding parts of the actuator 9 may be vibrated by actuation of the piezoceramic element 11. For example, in the example of FIG. 1, the actuation in the direction of movement M may be especially present next to the supported portion 14, on at least two sides of the supported portion 14. In an embodiment, the interruption 12 may be provided at the supported portion 14, for example below or above the supported portion 14, as seen from a side or front view. The piezoceramic element 11 then extends next to the supported portion 14, as seen from a side or front view.

The fluid chamber 2 may comprise at least one inlet 15 for letting fluid into the fluid chamber 2. The inlet 15 may for example be provided in either of the chamber walls 3, 4, 5A-D. In the drawing the inlet is provided in the side wall 5B. The inlet 15 and outlet 6 may be provided at opposite positions in the volume of the chamber so that fluid sweeps through all points in the volume. For example, the inlet 15 and the outlet 6 may be provided in or near opposite walls 3, 4 and/or in or near opposite side walls 5A, 5B or 5C, 5D. In the shown embodiment, the outlet 6 extends in the top wall 3, near a respective side wall 5A, and the inlet 15 extends in an opposite side wall 5B, near the bottom wall 4. In an embodiment, one or more support elements 13 may extend between the outlet 6 and the inlet 15. The respective support element 13 may extend in the fluid chamber 2, i.e. between or within the at least one side wall 5A-D.

The support element 13 may comprise a post. The post may be substantially cylindrical, and/or may have a substantially rounded, for example circular or elliptical, circumferential wall. Amongst others, a post shape may be desirable to maximize the area of the moving portion of the actuator. The unit 1 may comprise an array of posts.

The cross sectional lateral thickness C of the support element 13 may, for example, be between approximately 5 and approximately 30 micron, for example 10 to 15 micron. An exemplary cross sectional thickness C of the depicted support element 13 may be approximately 15 micron. The minimal cross-sectional thickness may be determined by the depth of the chamber 5, the type of etch process, and non-uniformity in the cross-sectional thickness C that allows adequate flow.

The actuator 9 may comprise two independently controllable piezoceramic elements 11A, 11B. For example, an independently controllable piezoceramic element 11A, 11B may extend on one side of a respective support element 13.

Use of the support element 13 may allow the span of the thin film actuator 9 to be increased with respect to conventional printhead units having an actuator of the same thickness. If needed, a conventional elongate shape of the fluid chamber 2 may be avoided by using the support element 13. Instead, more space efficient chamber shapes may be achieved. In an embodiment, the basic shape of the fluid chamber 2, as seen from a top view, may for example be approximately circular, square, hexagonal, any cyclic polygon, or the like. Of course, such shapes may be slightly modified, for example corners may be rounded and/or clipped, or lengths may be slightly longer than widths. For example, advantageous shapes may include elliptical, rhomboidal, and/or rectangular shapes, as seen from top view. In an embodiment, the length of the fluid chamber 2 may be between approximately one and three times the width of the fluid chamber 2. Here, the length L and width W may be regarded as the distances between opposite side walls 5A-D in two perpendicular directions, in a plane parallel to a top or bottom wall of the unit 1. The height H of the chamber 2 may refer to the distance between a bottom and top wall 3 and 4 of the chamber 2.

A distance D between adjacent support elements 13 may be between 20 and 90 microns, for example between 30 and 80 microns. For example, the distance between adjacent support elements may be approximately 55 micron. The minimal distance may be determined by the depth of the chamber 5, the type of etch process, and/or the opening size between the adjacent support elements 13 that may allow for adequate flow. Like-wise, a distance between a support element 13 and a side wall may be between 20 and 90 microns, for example 55 micron. In an embodiment, the actuator 9 may span the entire fluid chamber 2 over a distance of at least approximately 115 micron in two perpendicular directions, for example at least approximately 150 micron. Said distance may be the distance between opposite side wall portions 5A, 5B or 5C, 5D. One or more support elements 13 may support the actuator 9 so as to obtain a relatively wide span. The support elements 13 may be arranged to reduce the maximum unsupported span of the actuator 9, i.e. between support elements 13 and/or between a support element 13 and a wall 5A-D, by at least half of the width of the chamber 2.

The thickness T of the piezoceramic element 11 may be approximately 5 micron or less, for example approximately 3 micron or less, for example 1.5 micron or less. The thickness T of the piezoceramic element 11 may for example be approximately 0.5 micron. The thickness of the actuator 9 may for example be 10 micron or less, for example between approximately 1 and approximately 10 micron, for example between approximately 2.5 and approximately 5.5 microns. The support element 13 may allow for relatively thin actuators 9 spanning relatively wide fluid chambers 2. The total span of the actuator 9 over the fluid chamber 2 between opposite side wall portions may be at least 150 micron or more in two perpendicular directions, while the thickness of the actuator 9 may be 5 micron or less, for example 1.5 micron or less. The total span may be much higher, for example depending on the arrangement and number of support elements 13 that is used in the unit 1.

If a support element 13 supports the actuator 9 approximately in the middle between side wall portions of a fluid chamber 2, or in the middle between two support elements 13, a thickness of the actuator 9 may be reduced approximately 2.5 times while achieving the same displacement of the actuator 9 in the direction of actuation movement M. In other words, by decreasing an unsupported actuator span to one half of the original unsupported span, the thickness of the actuator may be reduced approximately 2.5 times for a similar displacement. Furthermore, by decreasing an unsupported actuator span to one half, the thickness of the actuator may be reduced approximately 2 times without loss of pressure. Therefore, by selectively placing support elements 13 the dimensions of the fluid chamber 2 may be chosen relatively freely.

Formulas may be used for estimating a level of stress $\sigma$ and a maximum displacement $y_{max}$ at the center of a rectangular membrane 10. In below formulas, a uniform load is applied across the whole surface of the rectangular membrane 10. This situation may for example correspond to a rectangular actuator 9 having a piezoceramic element 11 applying a load across substantially the whole surface of the membrane 10, and clamped by four side walls 5A-D. An indication of the maximum displacement $y_{max}$ of the membrane 10 at the center of the membrane 10 may be obtained through equation $$y_{max} = \frac{\alpha q b^4}{E t^3}$$

wherein $\alpha$ represents a constant factor indicated below, E represents the modulus of elasticity, t represents the thickness of the membrane, b represents the width of the membrane 10 between the side walls 5C-D and q represents the applied pressure across the surface. For identical conditions, an indication of the stress $\sigma$ in the membrane 10 at the center of the membrane 10 may be obtained through equation $$\sigma = \frac{\beta_2 q b^2}{t^2}$$

wherein $\beta_2$ is a constant. The following table may be used for retrieving the constant factors $\alpha$ and $\beta_2$, and a represents the length of the membrane 10 between the side walls 5A-B.

| a/b | 0.25 | 0.5 | 0.75 | 1.0 | 1.5 | 2.0 | ∞ |
|---|---|---|---|---|---|---|---|
| $\beta_2$ | 0.1386 | 0.1794 | 0.2094 | 0.2286 | 0.2406 | 0.2472 | 0.2500 |
| $\alpha$ | 0.0138 | 0.0188 | 0.0226 | 0.0251 | 0.0267 | 0.0277 | 0.0284 |

When for the same chamber 2 and an equal actuator 9, a row of support elements 13 is positioned along the center-line of the membrane 9, i.e. in the middle between respective sidewalls 5C-D, the resulting change in thickness t, stress $\sigma$ and/or displacement $y_{max}$ may be estimated by decreasing the value of b by one half of its value without support elements 13. A resulting change in maximum pressure may correspond to the change in stress $\sigma$.

The theoretical situation sketched above corresponds to a membrane 10 that is composed out of one layer. When applying multiple layer actuators 9, the values of constants such as E, $\alpha$ and $\beta_2$ may change. However, the exponents for thickness t and width b may be close enough to estimate a general impact of placing support elements 13. Therefore, a general impact of placing support elements 13 in relation to total actuator 9 thickness and spans may be estimated using these formulas. For example, when support elements 13 are taken into account, the following formulas may be used:

$$(b_2/b_1)^4=(t_2/t_1)^3$$

wherein $t_1$ and $b_1$ are the initial thickness and width of the membrane 10, and $b_2$ is a width of the span between bisecting support elements 13 and the respective side wall 5, wherein $$b_2=(1-\epsilon)b_1/2$$

wherein $\epsilon$ is the width of the support element 13 indicated in the form of a percentage of the width of the entire chamber 2. For example, for $\epsilon=0$, $t_2 \approx t_1/2.5$ and for $\epsilon=0.14$, $t_2 \approx t_1/3$. Hence, if a single row of support elements 13 bisects the chamber and the width of the support element 13 is included, having a width of approximately 14% of the total chamber width, the thickness of the actuator 9 may be reduced at least 3 times for a similar displacement $y_{max}$, and the thickness t may be reduced at least 2.3 times without loss of pressure.

To achieve approximately the same displacement and pressure after inserting the support elements 13 and reducing the thickness of the actuator 9, the patterning of the piezoelectric element 11 and other geometrical factors may be adjusted. Furthermore, instead of, or in addition to above formulas, actual values may be calculated through finite element analysis models and/or experiments.

A method of producing a unit 1 may comprise patterning thin film piezoceramic material on a membrane 10. For example thin film piezoceramic material may be deposited on the membrane 10 and afterwards sintered. Amongst others, deposition of the piezoceramic material may be performed by sputtering, sol gel coating, aerosol impingement, or the like. In another embodiment, a thin film piezoceramic element may be patterned by etching a substrate comprising piezoceramic material, for example using a photolithographic method.

The resulting actuator 9 may have a thickness of 5 micron or less, for example 3 micron or less, or for example 1.5 micron or less. The fluid chamber 2 may be lithographically manufactured, or otherwise, by illuminating and etching a wafer. The surrounding parts of the wafer may form the side walls 5A-D. For example, the lithographically processed wafer may comprise the side walls 5A-D and the support elements 13. The thin film actuator 9 may be connected to the wafer, such as the side walls 5A-D, for example after the fluid chamber 2 and the support elements 13 were etched. The support element 13 may extend between the at least one side wall 5A-D of the chamber 2, so that the support element 13 supports the thin film actuator 9 after connection with the wafer portion.

A method of shooting a fluid drop by piezoelectric actuation using the unit 1 may comprise the following. In response to an actuation of the piezoceramic element 11, the membrane 10 may be vibrated. The vibrations generate transient pressure pulses in the fluid inside the chamber 2, which may cause fluid to flow in the direction of the outlet 6, and one or more drops to shoot from the nozzle 7. The membrane 10 may be supported by at least one fluid chamber wall 5A-D and at least one support element 13 so that the membrane deflects on at least two sides next to the respective support element 13, at least as seen from a top view. Deflection in the actuator 9 is inhibited where it is attached to the respective support element 13, e.g. at the supported portion 14, at least in the direction of movement M. The fluid in the fluid chamber 2 may flow along the respective support element 13 as a response to the vibration on the at least two sides of the support element 13, in the direction of the outlet 6, and a fluid drop may be ejected from the respective outlet 6.

In FIG. 2A-D, another embodiment of a unit 1 is shown. In this embodiment, the support element 13 may comprise a partition wall. A support element 13 having a wall shape may be convenient as fluid may flow along the wall relatively easily so that a fluid flow in the chamber 2 is not affected, or at least affection of the fluid flow may be reduced. The partition wall may extend within the fluid chamber 2, for example approximately parallel to at least one of the side walls 5A-D of the fluid chamber 2. The partition wall may be arranged not to impede the fluid flow between the inlet 15 to the outlet 6. The partition wall may extend longitudinally between the inlet 15 and the outlet 16. The partition wall may be arranged approximately parallel to or along a main direction of flow F of the fluid, wherein the main direction of flow F of fluid may for example be determined by taking the average flow direction and/or by drawing an imaginary line between the inlet 15 and the outlet 6. For example, multiple partition walls may be provided. A lateral thickness C of the partition wall may be between approximately 5 and approximately 30 micron, for example between approximately 10 and approximately 15 micron, for example, approximately 15 micron.

Figure 3:
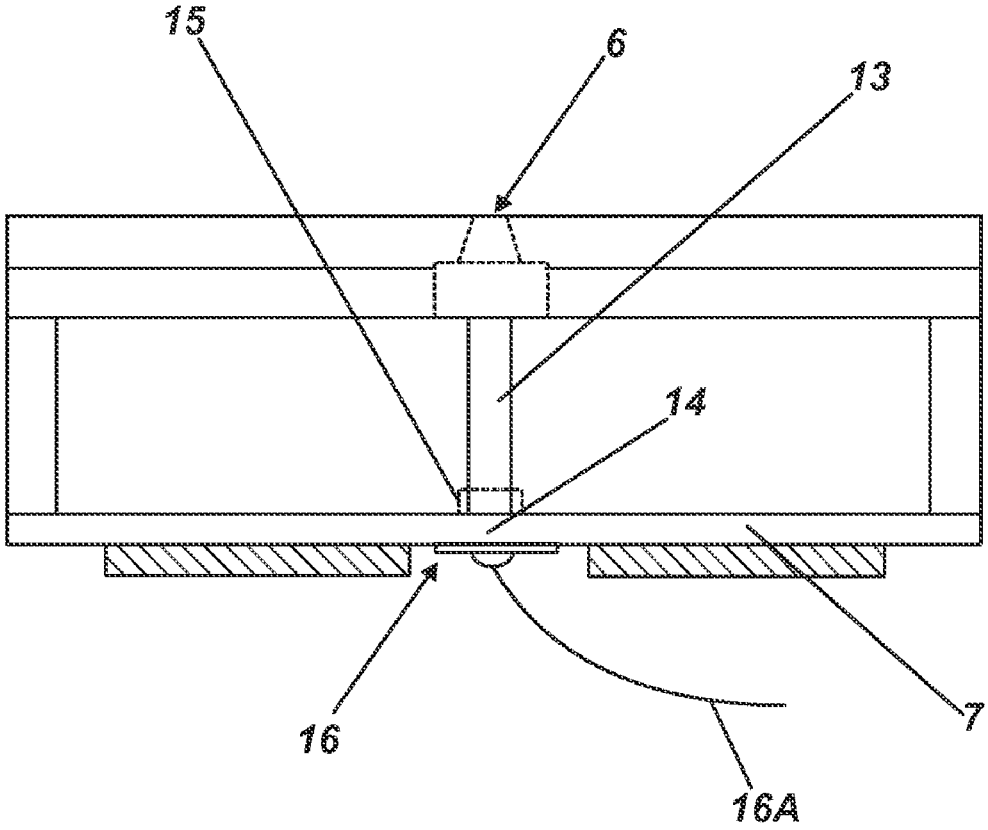
FIG. 3 is a schematic cross sectional front view of a piezoelectric inkjet printhead unit.

In FIG. 3, a further embodiment is shown. The unit 1 may comprise at least one support element 13 and at least one corresponding supported portion 14. The support element 13 may extend within the fluid chamber 2. The piezoceramic element 11 may comprise a patterned piezoceramic element 11 comprising an interruption 12 at near the supported portion 14. An interconnect electrode 16 for connection to a further electrical drive circuit may be provided at the supported portion 14, within the interruption 12. The interconnect electrode 16 may be arranged to connect multiple independently controllable piezoceramic elements 11A, 11B to a driving circuit. In an embodiment, a separate interconnect electrode 16 may be provided for each separate piezoceramic element 11A, 11B. For example, if separate piezoceramic elements 11A, 11B are arranged to be independently controlled, then each may be provided with a corresponding interconnect electrode 16 for interconnection with the drive circuit. The interconnect electrode 16 may comprise a conductive bonding pad that is arranged to contact the piezoceramic element 11 with the further electrical circuit. The further electrical circuit may comprise at least one wire 16A and/or trace or the like.

The interruption 12 and the support element 13 may conveniently allow a driving interconnect electrode 16 to be placed onto the supported portion 14. The interruption 12 may prevent that the interconnect electrode 16 needs to be placed onto the piezoceramic element 11. By placing the interconnect electrode 16 onto the supported portion 14, which is kept relatively static by the support element 13, vibration of the interconnect electrode 16 may be prevented and a relatively stress-free attachment may be achieved. As shown in FIG. 3, an interconnect electrode 16 may be connected directly to the thin film membrane 7, between the at least one sidewall 5A-D of the fluid chamber 2, for example near or at the middle of the actuator 9.

As is known in the art, an actuator 9 may comprise at least two electrodes (not shown) connected to a piezoelectric element, with a voltage between the electrodes. An embodiment may have electrodes on opposing surfaces of the piezoceramic element 11. The respective electrodes on the plane at the interface between the respective piezoceramic elements 11 and the membrane 10, hereafter called "inside electrodes", may form part of the same layer and may have the same voltage with respect to the ground. In fact, the inside electrode layer may be maintained at ground potential. When the piezoceramic element 11 comprises patterned piezoceramic elements 11A, 11B, an interface conductive layer, which may extend between the electrodes and the piezoceramic elements 11, may be continuous, so that each inside electrode may be electrically connected to the respective piezoceramic elements 11A, 11B via the interface conductive layer. The opposite electrodes, i.e. on the outside of the piezoceramic element 11, opposite to the membrane 10, may be connected to the interconnect electrode 16 via conductive thin film strips. In a method of manufacturing, the conductive thin film strips may be added after the piezoceramic element 11 is patterned to the membrane 10. To avoid an extra processing step, the inside electrode may be continuous. In an embodiment where each of the piezoceramic elements 11A, 11B are independently controlled, a conductive film may extends from each separate interconnect electrode 16 associated with each outside electrode.

In other embodiments, two electrodes may be provided in the same plane and/or on the outside surface of the piezoceramic element 11. Multiple electrodes may be provided and interdigitated with every other electrode having the same voltage, and connected to corresponding patterned piezoceramic elements 11A, 11B.

Figure 4:
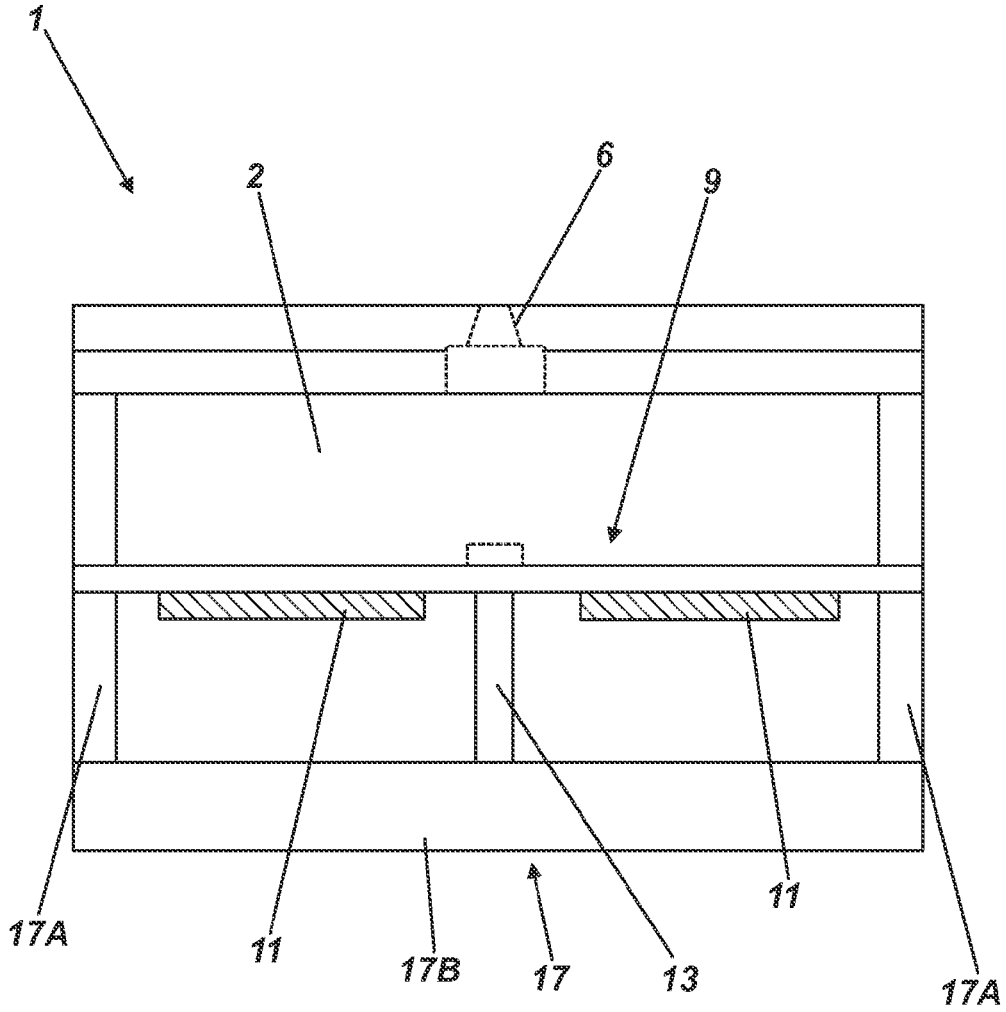
FIG. 4 is a schematic cross sectional front view of a piezoelectric inkjet printhead unit.

In FIG. 4 an embodiment is shown, wherein the support element 13 may be arranged outside of the fluid chamber 2. The support element 13 may be connected to a printhead portion 17 that extends approximately at least partly opposite to the actuator 9, and outside of the ink chamber 2. Said portion 17 may be a relatively stiff portion. Said portion 17 may comprise a cap and/or protective layer for protecting and/or hermetically sealing the piezoceramic elements 11, in addition supporting the support element 13. For example, the portion 17 may comprise upstanding walls 17A and or a section 17B opposite to the actuator 9.

Figure 5:
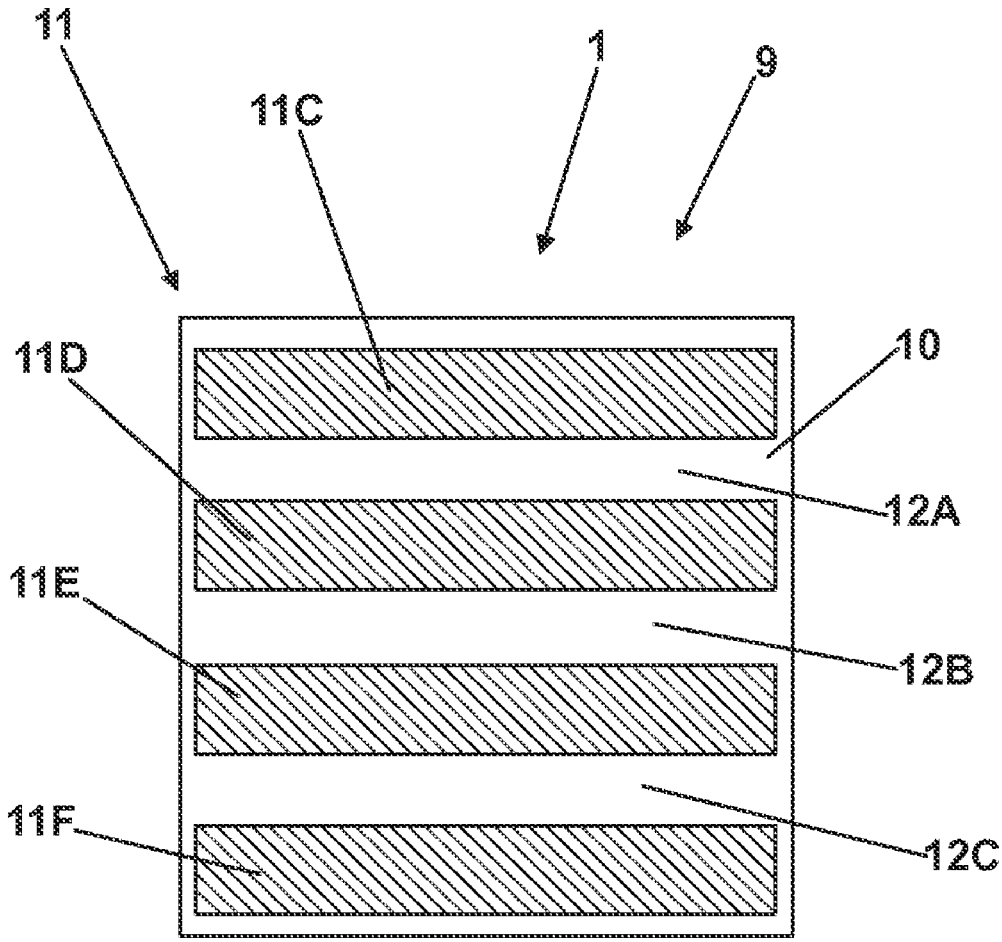
FIG. 5 is a schematic top view of a piezoelectric inkjet printhead unit.

FIG. 5 illustrates another embodiment of a piezoelectric inkjet printhead unit 1 in top view. The unit 1 may comprise a patterned piezoceramic element 11. The patterned piezoceramic element 11 may comprise multiple separated piezoceramic elements 11C-F. In the shown example, four piezoceramic elements 11C-F are provided. The separate piezoceramic elements 11C-F may be independently controllable. The separate piezoceramic elements 11C-F may extend approximately parallel with respect to each other. The actuator 9 may comprise multiple interruptions 12A-C between the piezoceramic elements 11C-F, for example three interruptions 12A-C.

Figure 6:
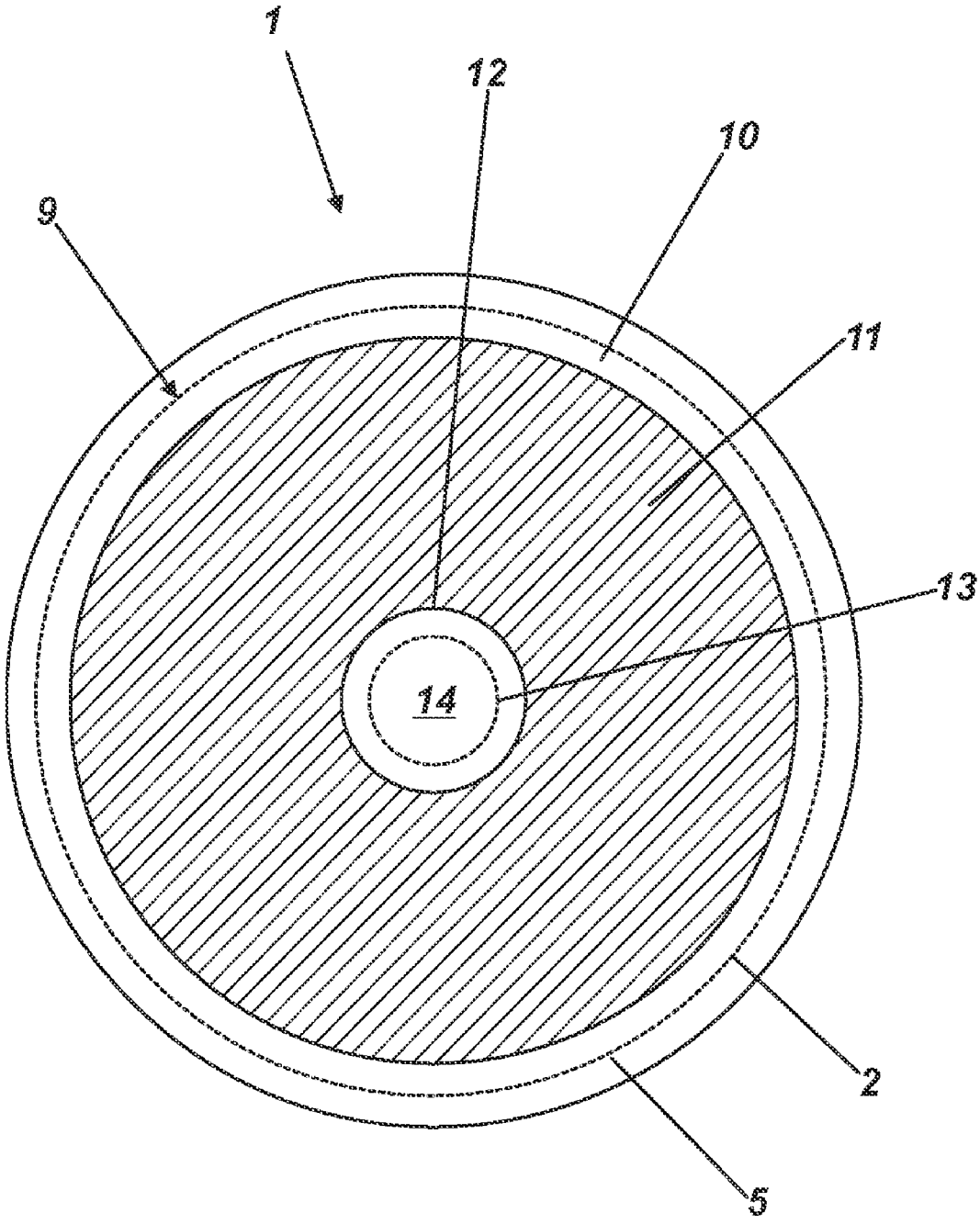
FIG. 6 is a schematic top view of a piezoelectric inkjet printhead unit.

FIG. 6 illustrates another embodiment of a piezoelectric inkjet printhead unit 1 in top view. The fluid chamber 2 may have an approximately circular shape, as seen from top view. The fluid chamber 2 may comprise one side wall 5. The side wall 5 may be substantially circular. The unit 1 may comprise a support element 13 arranged approximately against a middle portion of the actuator 9. The unit 1 may comprise a support element 13 and corresponding supported portion 14 arranged approximately in the middle of the chamber 2, as seen in the top view.

The actuator 9 may comprise an interruption 12 at the supported portion 14. The actuator 9 may comprise a substantially circular shaped piezoceramic element 11. The interruption 12 may be provided approximately in a middle portion of the piezoceramic element 11. The piezoceramic element 11 may be arranged next to the support element 13 and next to the side wall 5, between the support element 13 and the side wall 5, as seen from a top view.

At portions of the membrane 10 that are relatively close to the support element 13, or that are close to a respective side wall 5, vibration may be impeded. Therefore, the piezoceramic element 11 may be arranged at a distance from the respective support element 13 and/or at a distance from the respective side wall 5, as seen from a top view. For example, such distance may be at least 1 micron, or at least 5 micron, or at least 10 micron.

Figure 7:
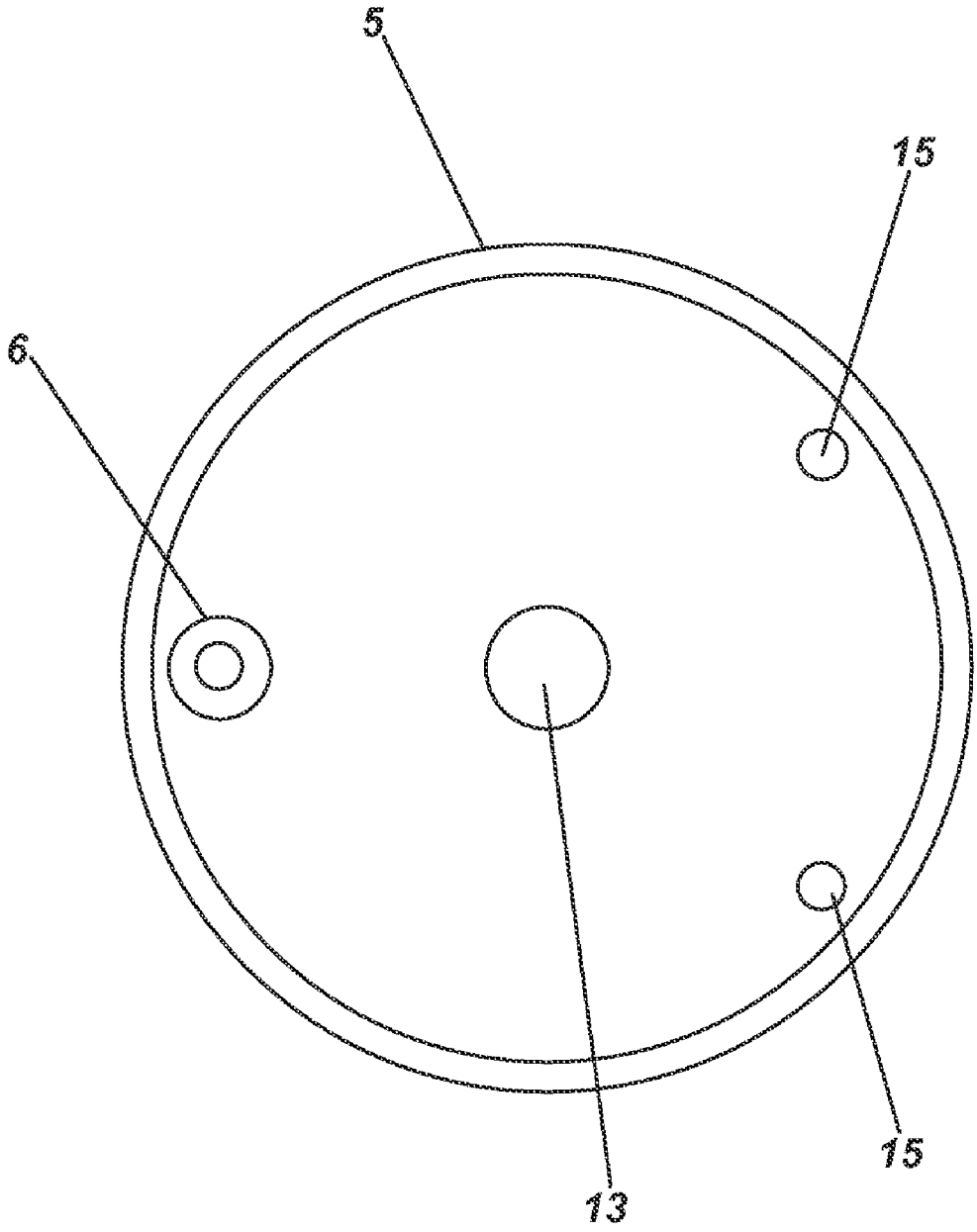
FIG. 7 is a schematic top view of a piezoelectric inkjet printhead unit, wherein the actuator is removed for illustrative purposes.

In FIG. 7, a further embodiment of a unit 1 is shown, wherein a top view of the fluid chamber 2 is shown. The chamber 2 may comprise a circular or a cyclic polygonal shape, as seen from top view, having a circular wall 5 or a wall 5 having a cyclic polygonal shape. The support element 13 may comprise a post. The support element 13 may extend approximately in the middle of the chamber 2, as seen from a top view. For example, two inlets 15 may be provided. The support element 13 may extend between the inlets 15 and the outlet 6. The location of the inlets 15 may be provided by using a computational fluid dynamics model. In this way, fluid may advantageously flow past the support element 13. Also, two inlets 15 may provide for more uniform flow through the fluid chamber 2, and hence sweep out the chamber 2.

Figure 8:
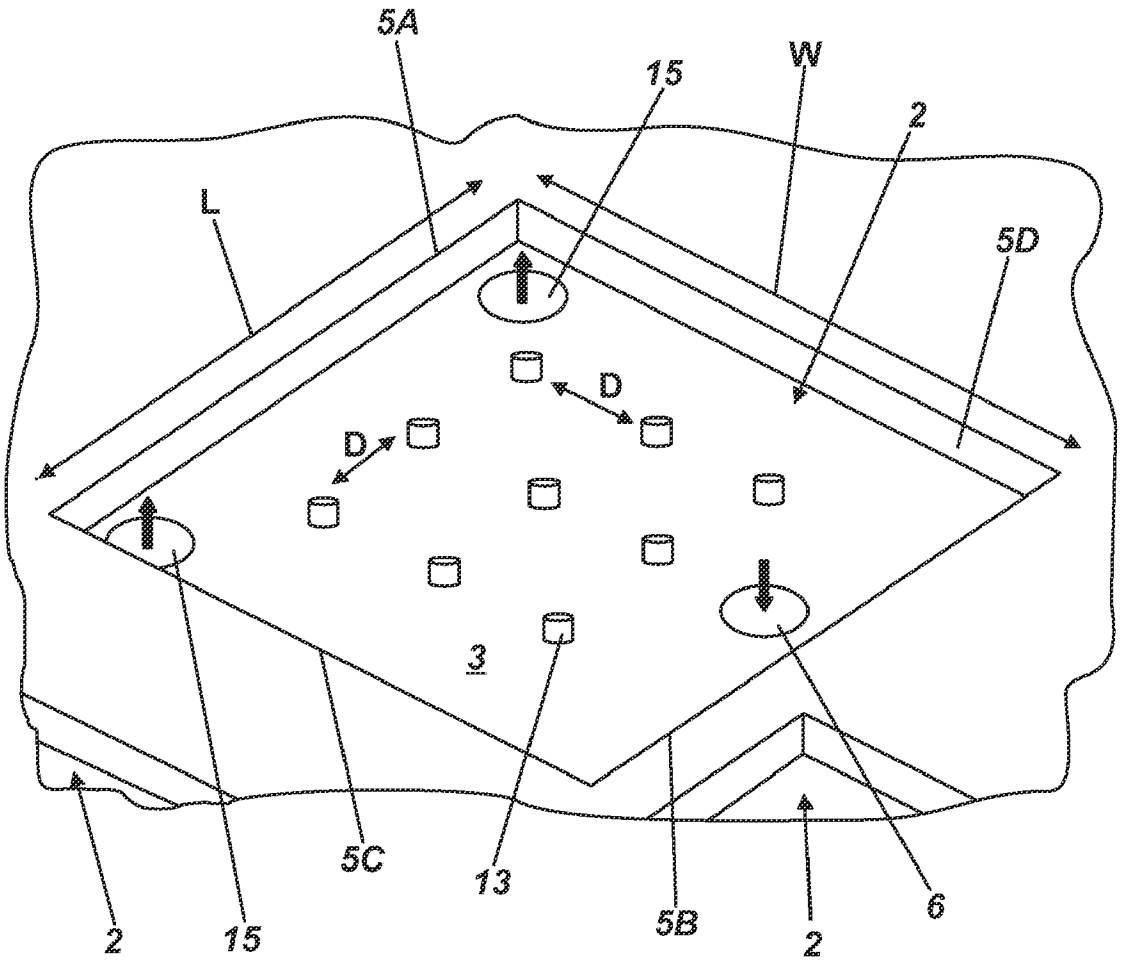
FIG. 8 is a schematic perspective view of a piezoelectric inkjet printhead unit wherein the actuator is removed for illustrative purposes.

FIG. 8 shows an embodiment of a unit 1 in perspective view, wherein the actuator 9 has been removed. Parts of adjacent chambers 2 in the same wafer are also visible. An array of support elements 13 is shown. The array may comprise a matrix-like arrangement. For example two or more rows and/or columns of support elements 13 may be provided. In the shown arrangement, the support element array comprises three rows and three columns of support elements 13, i.e. nine support elements 13. The support elements 13 may be arranged at regular distances D from each other, for example of between approximately 30 and 80 micron, for example of approximately 55 micron. The length and/or width of the chamber may for example be between approximately 115 and 400 micron, for example approximately 265 micron. The array of support elements 13 may be arranged between the inlets 15 and the outlet 6. The inlets 15 may be arranged at the sides of the fluid chamber 2, near respective side walls 5C, 5D. The inlets 15 near the sides may allow for an advantageous flow of fluid in the chamber 2. Having multiple rows and/or columns of support elements 13 may allow for the actuator 9 to span a relatively wide fluid chamber 2. The interruptions 12 may be arranged at the supported portions 13 of the membrane 10 (not shown).

Figure 9:
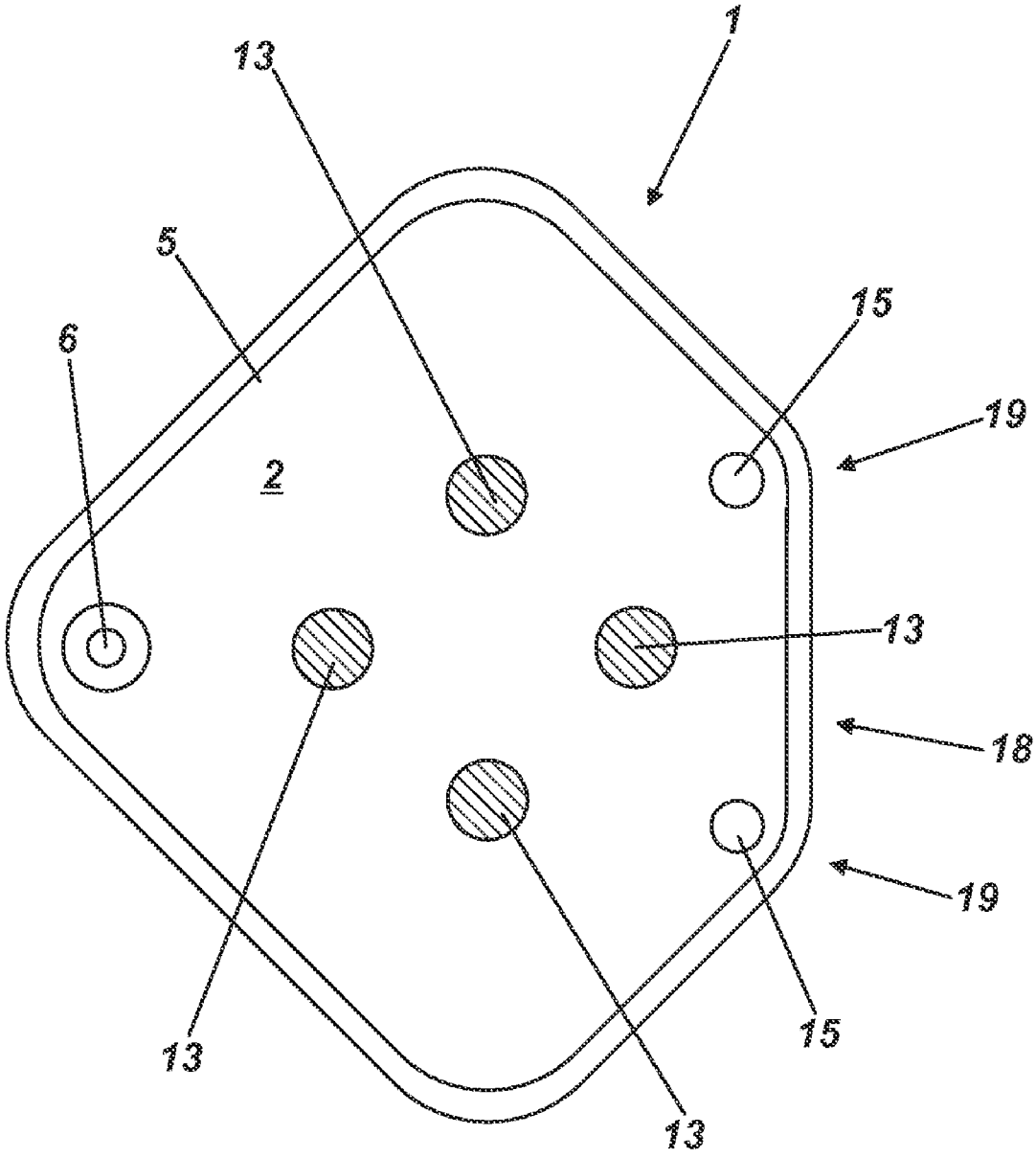
FIG. 9 is a schematic top view of a piezoelectric inkjet printhead unit, wherein the actuator is removed for illustrative purposes.

FIG. 9 shows a unit 1 in top view, wherein the actuator 9 is removed for illustrative purposes. The unit 1 may comprise an outlet 6 and two inlets 15. An array of support elements 13, for example four support elements 13 arranged at equal distances D from each other, may be provided between the outlet 6 and the inlets 15. The chamber 2 of the unit 1 may be substantially square shaped, wherein the corners may be rounded. As can be seen, the support elements 13 may be arranged in a corresponding square shape, wherein a support element 13 may be provided near each rounded or clipped corner. At least one of the side corners of the chamber 2 may be clipped, providing for a clipped side 18 of the chamber 2. Due to the clipping the chamber 2 may comprise another two corners 19 which may also be rounded. The outlet 6 may be provided at the rounded corner opposite to the clipped side 18 of the chamber 2. The inlets 15 may be arranged near the clipped side 18, for example near each rounded corners 19 of the clipped side 18. Such arrangement may allow for a relatively uniform fluid flow in the fluid chamber 2. The rounded corners may streamline the fluid flow, while the clipping may aid in distributing the fluid throughout the whole chamber 2.

Figure 10:
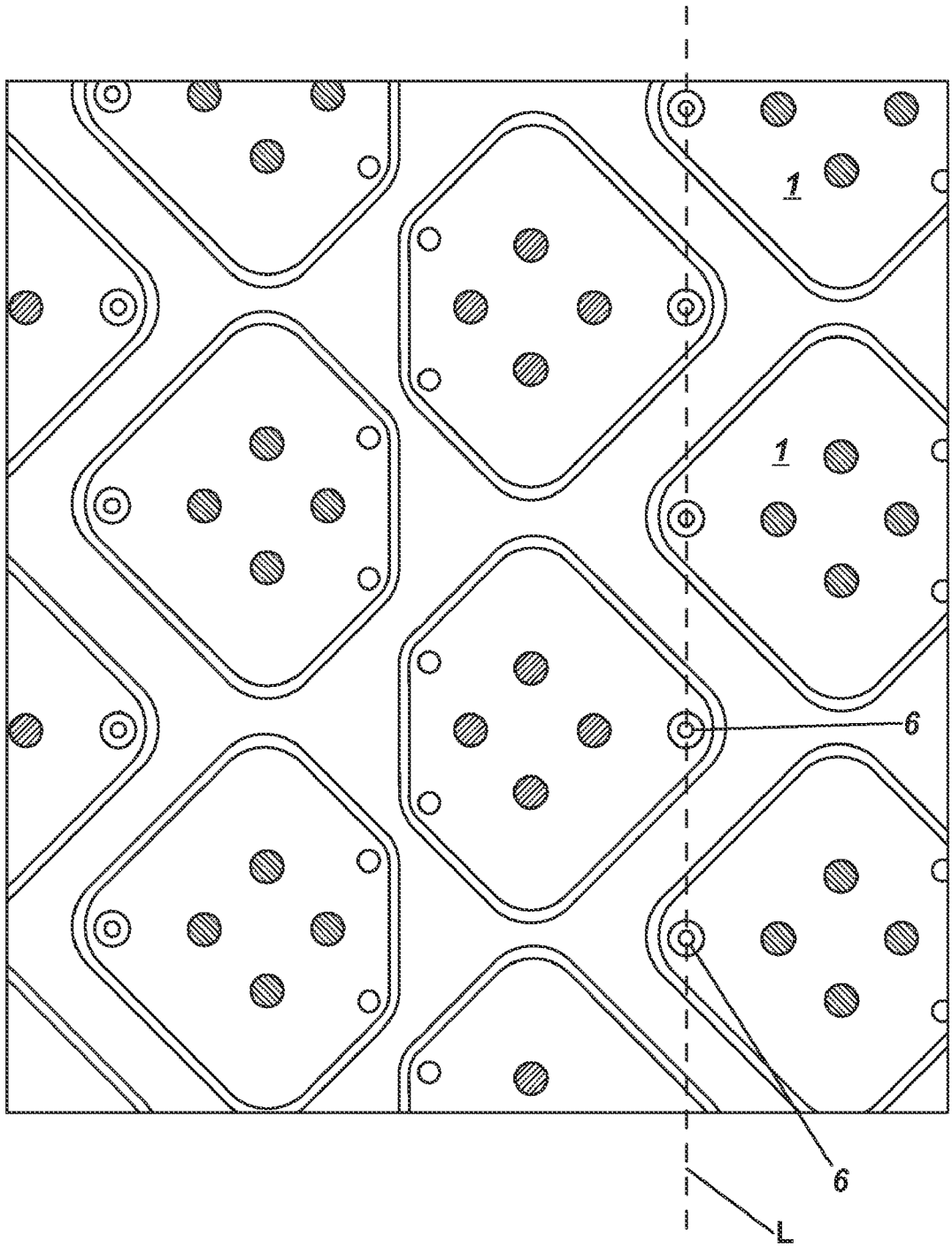
FIG. 10 is a schematic top view of a part of a piezoelectric inkjet printhead having printhead units of FIG. 9, wherein the actuators are removed from the respective printhead units for illustrative purposes.

FIG. 10 shows a part of a printhead wherein several units 1, which may correspond to the unit 1 of FIG. 9, are arranged in an array. As can be seen, the nozzles 7 of the units 1 may be arranged in rows and/or columns. The units 1 may be arranged like a matrix and/or along a diagonal straight line. The outlets 6 of different rows and/or columns of units 1 may be arranged approximately on the same imaginary straight line L, as is shown in FIG. 10. The shown embodiment may allow for a relatively high nozzle density of the printhead.

Figure 11:
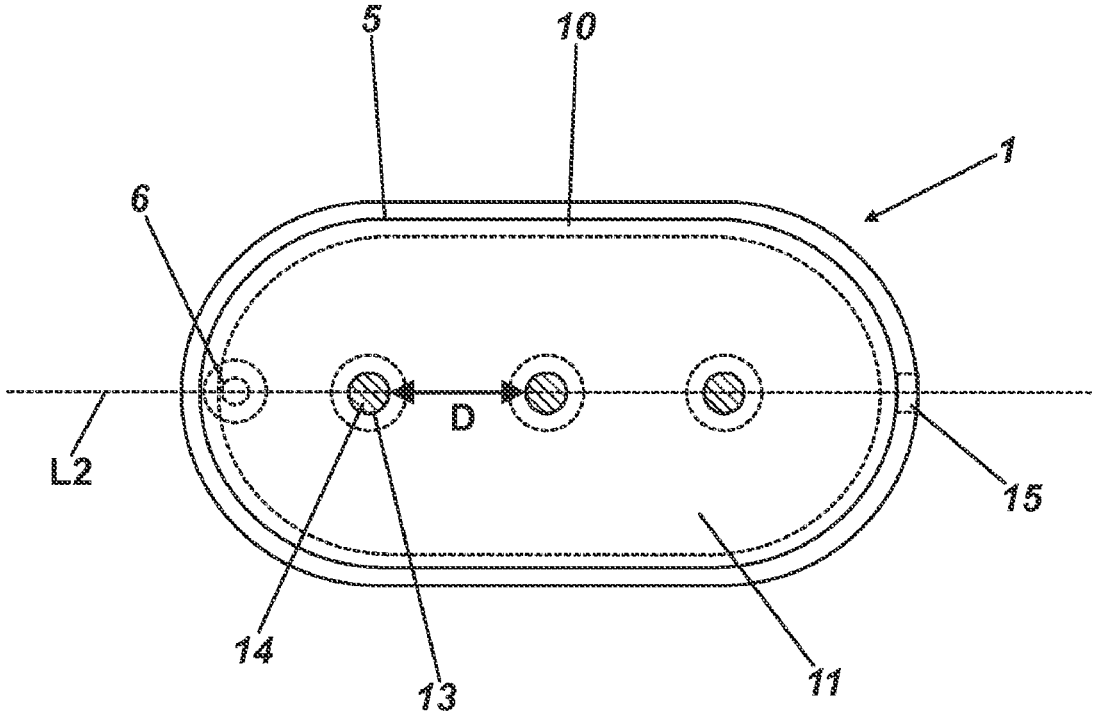
FIG. 11 is a schematic top view of a piezoelectric inkjet printhead unit, wherein the actuator has a patterned piezoceramic element. The actuator is shown transparent and in dashed lines for illustrative purposes.

FIG. 11 shows an embodiment, wherein the unit 1 has a substantially elongate shape, wherein the circumference of the side wall 5 of the chamber 2 may be shaped as a race track. The inlet 15 may be arranged near a longitudinal end of the chamber 2, for example in the side wall 5. The outlet 6 may be arranged at the opposite longitudinal end with respect to the inlet 15. Multiple support elements 13 may be arranged between the inlet 15 and the outlet 6. The support elements 13 may be arranged on an imaginary straight line L2 that can be drawn between the inlet 15 and the outlet 6, at least in a top view. The race track shape may allow for the fluid to be guided relatively uniformly throughout the whole chamber 2.

In FIG. 11, the piezoceramic element 11 is indicated in dashed lines. The piezoceramic element 11 may be patterned so as to comprise interruptions 12 at the supported portions 14. The interruptions 12 may have their boundaries at a certain distance from the supported portions 14 so that there may be a gap between the supported portion 14 and the piezoceramic element 11, at least as seen from a top view. Also, the circumferential boundary of the piezoceramic element 11 may extend at a certain distance from the side wall 5, at least as seen from a top view, as was also discussed with reference to FIG. 6.

The actuator 9 may have a thickness of approximately 2.5 micron. The distance D between adjacent support elements 13 and the distance between the support element 13 and the side wall 5 may for example be approximately 55 micron, or for example at least between 30 and 80 micron. The shown pattern of the piezoceramic element 11 may allow a relatively uniform displacement and stiffness of the actuator 9, also where spans are not exactly the same as said distance D. The shown example, having an actuator thickness of approximately 2.5 micron, and a distance D between support elements 13, and support elements 13 and side walls 5, of approximately 55 micron, may result in a maximum displaced volume of fluid of approximately 3.3 picoliters per deflection of the actuator 9 into the outlet 6.

Figure 12:
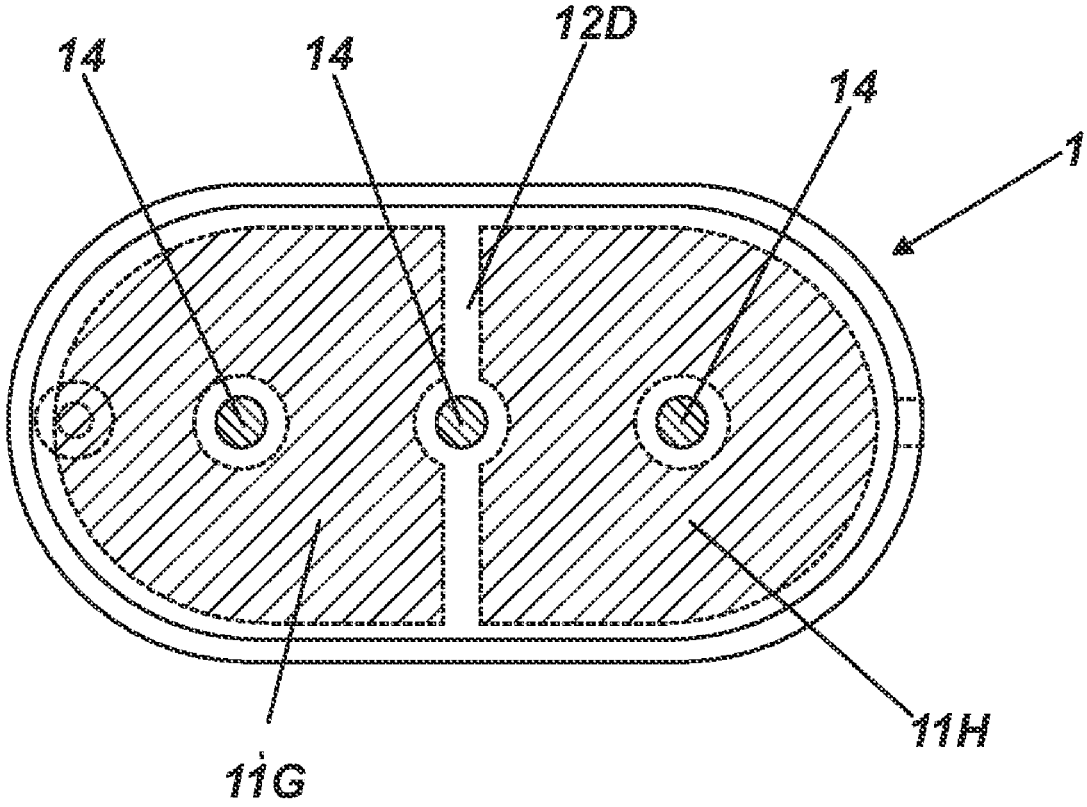
FIG. 12 is a schematic top view of a piezoelectric inkjet printhead unit, wherein the actuator has a patterned piezoceramic element comprising two separate piezoceramic elements. The actuator is shown transparent and in dashed lines for illustrative purposes.

FIG. 12 shows an embodiment of a unit 1 similar to FIG. 11, having a distinguishing feature with respect to FIG. 11. A dividing interruption 12D may divide the piezoceramic element 11 into two separate piezoceramic elements 11G, 11H. The separate piezoceramic elements 11G, 11H may be independently controllable. Corresponding electrodes 16 (not shown in FIG. 12) may be arranged on at least one of the supported portions 14, and attached to each of the piezoceramic elements 11G, 11H.

The dividing interruption 12D may extend over at least one of the supported portions 14. The dividing interruption 12D may comprise an opening extending laterally over the width of the membrane 10, in the middle of the membrane 10, at least as seen from a top view.

In an embodiment, the separate, independently controllable piezoceramic elements 11G, 11H may be non-simultaneously actuated so as to achieve better fluid flow.

Advantageously, the patterning of the respective piezoceramic elements 11 may be adapted to achieve maximum deflection. The thickness of the membrane 10 and/or the thickness of the piezoceramic element 11 may be adapted to achieve a desired fluid pressure. This may apply to every actuator 9 within this disclosure. Every design may be optimized to achieve the largest possible displacement with a pressure that meets the flow speed desired at the outlet.

Although it may be advantageous to provide for interruptions 12 at supported portions 14, as described above, in certain embodiments the piezoceramic element 11 may extend over the supported portion 14 and the support element 13 or the sidewalls 5A-D without interruption. Furthermore, the invention does not exclude the use of elongate fluid chamber shapes.

Although in this description, a unit 1 for an inkjet printhead is described, in other embodiments, the unit 1 may comprise any type of piezoelectric actuator, for example other than a piezoelectric inkjet printhead unit. For example, the fluid may comprise a liquid and/or gas. The unit 1 may be part of a MEMS (micro electro mechanical system) device that moves fluid, wherein the MEMS device may for example form part of a lab on a chip. In other embodiments, the unit 1 may comprise a speaker or tone generating device for displacing air. In again another embodiment, the unit 1 may comprise a device for moving a component, for example controlling the position of tips in an atomic force microscope.

In a first aspect, a piezoelectric unit 1 is provided, comprising (i) a fluid chamber 2, (ii) a fluid outlet 6, (iii) an actuator 9. The unit 1 may comprise a thin film piezoceramic element 11 and a membrane 10, acting as a wall 4 of the fluid chamber 2, and (iv) a support element 13 arranged for preventing a supported portion 14 of the actuator 9 from movement in a main direction of actuation movement M of the actuator 9, while allowing such actuation movement M on at least two sides of the supported portion 14, wherein the support element 13 may be connected to a unit portion 4, 17 that may extend approximately opposite to the actuator.

In a second aspect, a method of ejecting a fluid drop by piezoelectric actuation may be provided. The method may comprise (i) actuating a piezoceramic element 11, (ii) vibrating a membrane 10 that is supported by at least one fluid chamber wall 5, 5A-D and at least one support element 13 so that the membrane 10 deflects on at least two sides next to the respective support element 13 and deflection in the membrane 10 is inhibited at the portion 14 where it is attached to the respective support element 13, (iii) fluid in the fluid chamber 2 flowing along the respective support element 13 as a response to the vibration on the at least two sides of the support element 13, in the direction of an outlet 6 that opens into the chamber 2, and (iv) a fluid drop ejecting from the respective outlet 6 by the vibration.

In a third aspect, a method of producing a piezoelectric unit 1 may be provided. The method may comprise (i) creating a thin film actuator 9 by patterning piezoceramic material on a membrane 10, wherein the actuator 9 may have a thickness t of approximately 5 micron or less, and (ii) connecting the actuator 9 to a wafer, wherein the wafer may comprise a fluid chamber wall 5, 5A-D and a support element 13, the support element 13 extending between at least one side wall 5 of the chamber 2, as seen from a direction perpendicular to the surface of the actuator 9 after connection, so that the support element 13 and the wall 5 may support the thin film actuator 9 after connection with the wafer.

The above description is not intended to be exhaustive or to limit the invention to the embodiments disclosed. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality, while a reference to a certain number of elements does not exclude the possibility of having more elements. A single unit may fulfil the functions of several items recited in the disclosure, and several items recited in the disclosure may fulfil the function of one unit.

The mere fact that certain measures are recited in mutually different dependent claims does not indicate that a combination of these measured cannot be used to advantage. Multiple alternatives, equivalents, variations and combinations may be made without departing from the scope of the invention.

The invention claimed is:

1. Piezoelectric unit, comprising
one or more fluid chambers,
one or more fluid outlets,
an actuator, comprising a thin film piezoceramic element and a membrane, acting as a wall of the one or more fluid chambers, and
a support element positioned a first side and a second side of the fluid chamber and arranged for preventing a supported portion of the actuator from movement in a main direction of actuation movement of the actuator, while allowing such actuation movement of the actuator within the fluid chamber on at least two sides of the supported portion, wherein the support element is connected to a unit portion that extends approximately opposite to the actuator, the support element not dividing the fluid chamber into two fluidically separate chambers.

2. Piezoelectric unit according to claim 1, wherein the thickness of the piezoceramic element is approximately five micron or less.

3. Piezoelectric unit according to claim 1, wherein the thickness of the piezoceramic element is approximately 1.5 micron or less.

4. Piezoelectric unit according to claim 1, comprising a deposited and sintered piezoceramic element.

5. Piezoelectric unit according to claim 1, wherein the actuator comprises a patterned piezoceramic element.

6. Piezoelectric unit according to claim 1, wherein the patterned piezoceramic element comprises two independently controllable piezoceramic elements.

7. Piezoelectric unit according to claim 1, wherein an interconnect electrode for connecting the actuator to a drive circuit is arranged at the supported portion of the actuator.

8. Piezoelectric unit according to claim 1, wherein the support element extends in the fluid chamber, from the bottom of the fluid chamber.

9. Piezoelectric unit according to claim 1, wherein the support element comprises a post.

10. Piezoelectric unit according to claim 1, wherein the length of the fluid chamber is between approximately one and three times the width of the fluid chamber.

11. Piezoelectric unit according to claim 1, wherein the actuator extends over the same fluid chamber over a distance of at least approximately 115 micron in two perpendicular directions.

12. Piezoelectric unit according to claim 1, wherein the distance between adjacent support elements is between 30 and 80 microns.

13. Piezoelectric unit according to claim 1, wherein the support element extends between the outlet and an inlet.

14. Method of ejecting fluid by piezoelectric actuation, comprising actuating a piezoceramic element, vibrating a membrane that is supported by at least one fluid chamber wall and a support element positioned between a first side and a second side of a fluid chamber so that the membrane deflects within the fluid chamber on at least two sides next to the support element and deflection in the membrane is inhibited at the portion where it is attached to the support element, the support element not dividing the fluid chamber into two fluidically separate fluid chambers, fluid in the fluid chamber flowing along the support element as a response to the vibration, in the direction of an outlet that opens into the fluid chamber, and fluid ejecting from the outlet by the vibration.

15. Method of producing a piezoelectric unit, comprising creating a thin film actuator by patterning piezoceramic material on a membrane, the actuator having a thickness of approximately 5 micron or less, and connecting the actuator to a wafer, the wafer comprising a fluid chamber wall and a support element, the support element extending between at least one side wall of a fluid chamber, as seen from a direction perpendicular to the surface of the actuator after connection, so that the support element and the fluid chamber wall support the thin film actuator after connection with the wafer, the support element not dividing the fluid chamber into two fluidically separate fluid chambers.

* * * * *